US011937687B1

(12) United States Patent
Beattie

(10) Patent No.: US 11,937,687 B1
(45) Date of Patent: Mar. 26, 2024

(54) DESK BACKPACK

(71) Applicant: JoCari Tyrelle Beattie, Louisville, KY (US)

(72) Inventor: JoCari Tyrelle Beattie, Louisville, KY (US)

( * ) Notice: Subject to any disclaimer, the term of this patent is extended or adjusted under 35 U.S.C. 154(b) by 246 days.

(21) Appl. No.: 17/669,659

(22) Filed: Feb. 11, 2022

Related U.S. Application Data

(60) Provisional application No. 63/148,507, filed on Feb. 11, 2021.

(51) Int. Cl.

| | |
|---|---|
| ***A45F 4/02*** | (2006.01) |
| ***A47B 3/10*** | (2006.01) |
| *A47B 3/083* | (2006.01) |
| *A47B 9/20* | (2006.01) |

(52) U.S. Cl.
CPC ..... *A45F 4/02* (2013.01); *A47B 3/10* (2013.01); *A47B 3/083* (2013.01); *A47B 9/20* (2013.01)

(58) Field of Classification Search
CPC ..... A45F 4/02; A47B 3/10; A45C 9/00
USPC ..... 224/575, 577, 153, 155–156, 581–582
See application file for complete search history.

(56) References Cited

U.S. PATENT DOCUMENTS

| | | | | |
|---|---|---|---|---|
| 1,286,118 | A * | 11/1918 | Russell | A47B 3/10 190/12 R |
| 3,557,916 | A * | 1/1971 | Stowell | A47B 3/10 190/18 R |
| 4,856,627 | A * | 8/1989 | Polatov | A47B 3/10 190/11 |
| 4,955,517 | A | 9/1990 | Maresca | |
| 5,284,280 | A | 2/1994 | Stonebraker, Sr. et al. | |
| 5,289,958 | A | 3/1994 | Jay | |
| D403,899 | S * | 1/1999 | Paparo, Jr. | D6/694 |
| 6,213,265 | B1 * | 4/2001 | Wang | A45C 9/00 280/37 |
| 9,381,128 | B2 * | 7/2016 | Rozewicz | A61G 13/009 |
| 2002/0023811 | A1 * | 2/2002 | Silvano | A47B 85/00 190/11 |
| 2004/0226791 | A1 | 11/2004 | Levy | |
| 2014/0216873 | A1 | 8/2014 | Torres Montes | |
| 2020/0163426 | A1 * | 5/2020 | Ungar | A45C 3/02 |
| 2021/0274904 | A1 | 9/2021 | Hanks | |
| 2021/0274918 | A1 | 9/2021 | Hanks | |
| 2021/0274928 | A1 * | 9/2021 | Hanks | A47B 23/041 |

FOREIGN PATENT DOCUMENTS

| | | |
|---|---|---|
| CN | 205006168 U | 2/2016 |
| CN | 109198867 A | 1/2019 |
| CN | 210433017 U | 5/2020 |

* cited by examiner

*Primary Examiner* — Scott T McNurlen
(74) *Attorney, Agent, or Firm* — Law Office of J. L. Simunic; Joan Simunic

(57) ABSTRACT

The present development is a convertible backpack desk. In a backpack configuration, the device can carry small portable items. The backpack also converts into a desk with telescoping legs.

11 Claims, 6 Drawing Sheets

DESK BACKPACK

CROSS-REFERENCE TO PRIOR APPLICATIONS

The present application claims priority to U.S. 63/148,507 filed 11 Feb. 2021, which is incorporated herein in its entirety by reference.

GOVERNMENT SUPPORT

The present invention was made without any government support.

FIELD OF THE INVENTION

The invention relates to a backpack capable of carrying portable items, such as a laptop computer and notebooks, that converts to a workstation.

BACKGROUND OF THE INVENTION

Selecting an ideal place to write or work has always created challenges for authors and artists. A table or desk provides a good working surface, but is not always readily available, such as when working outdoors or when in a public location. Moreover, in recent years, the concept of limiting work or study to a specially designated space has become obsolete. Mobile devices, such as laptop computers or digital tablets, allow a workstation to be wherever the user is located, whether in an office with a desk or at a table in a coffee shop or under a tree in a park or in an airport waiting area.

Not all locations that can serve as work areas have tables or desks available to provide a good working surface. This can leave the individual who is trying to work having to either juggle work supplies on his or her lap or having to provide his or her own work surface. Thus, it would be beneficial to have a device that allows the individual to carry work items to a location and then that converts into the work surface.

SUMMARY OF THE PRESENT INVENTION

The present development is a backpack capable of carrying small portable items that converts into a desk or working surface. The convertible backpack, or backpack desk, comprises a shell that unfolds to a flat surface and retractable legs that are positioned within the shell when in a closed configuration and that extend when the shell is in an open configuration. In a first embodiment, the shell comprises a plurality of segments, preferably comprising a hard or rigid material. In a second embodiment, the legs are telescoping.

DETAILED DESCRIPTION OF THE PRESENT DEVELOPMENT

Figure 1:
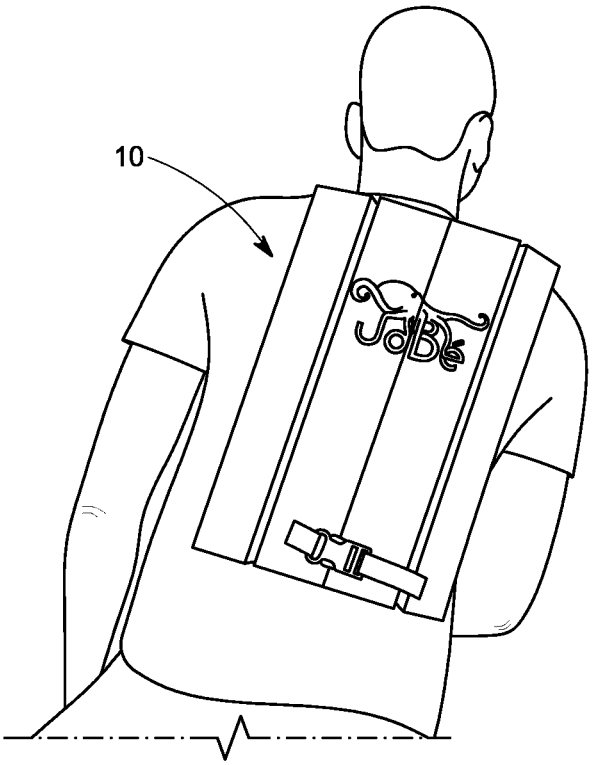
FIG. 1 shows the backpack desk product of the present development in a backpack configuration with a user carrying the backpack desk.
Figure 2:
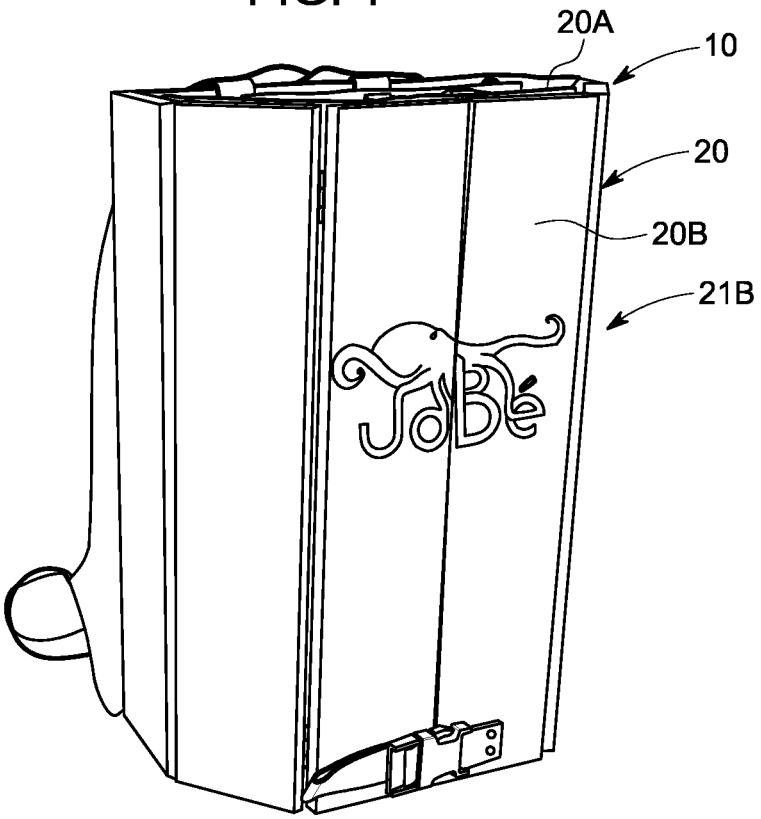
FIG. 2 is the backpack desk of FIG. 1 in a closed or backpack configuration.
Figure 3:
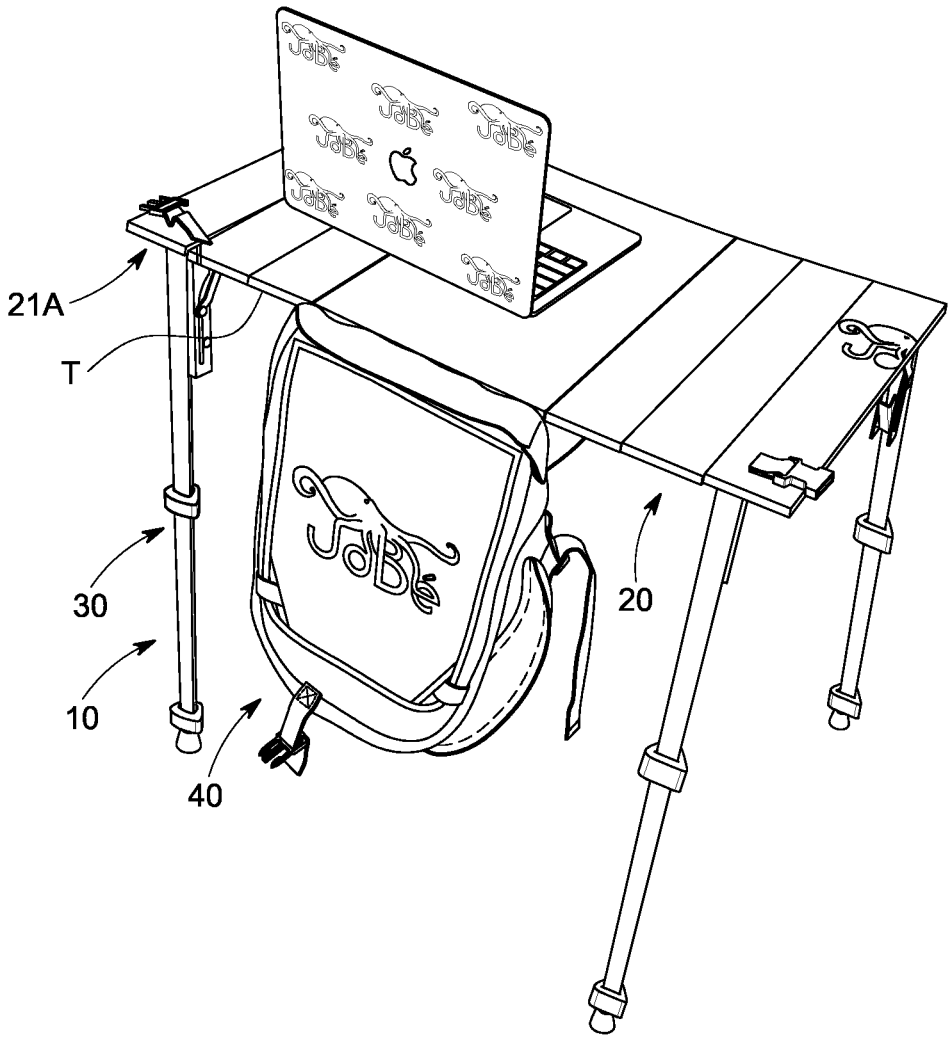
FIG. 3 is the backpack desk of FIG. 1 in an open or desk configuration.

The present development is a backpack that converts into a desk. As shown in FIGS. 1 and 2, the backpack desk 10 has a closed configuration, wherein the backpack desk 10 has a backpack configuration that can be easily carried by a user. As shown in FIG. 3, the backpack desk 10 also has an opened configuration, wherein the backpack desk 10 has a desk configuration that can serve as a flat working surface.

Referring to FIGS. 2-6, the backpack desk 10 comprises a shell 20, legs 30 and a carrier 40. The carrier 40 comprises a panel 42 fitted with straps 44. When the backpack desk 10 is in a closed position, the panel 42 is intended to rest against a user's back and the user's arms pass through the straps 44 to allow the user to carry the unit 10, as is known in the art. In a preferred embodiment, the shell 20 is connected to the panel 42 by internal anchors securing the pieces together. Any appropriate means for attaching the pieces may be used.

The panel 42 defines a length $L_P$ and a width $W_P$. Any materials commonly used for making backpacks or luggage or duffle bags or similar types of totes may be used in the present development for the panel and straps. Exemplary materials for the panel 42 include, but are not limited to, canvas, nylon, ripstop nylon, leather, polyester, polypropylene, polyethylene, ultra-high-molecular-weight polyethylene, cotton, polyvinyl chloride, and combinations thereof. In a preferred embodiment, the panel 42 is made from a padded material to provide comfort to the user when carrying the backpack desk 10, but padding is not required. Exemplary materials for the straps 44 include, but are not limited to, nylon, leather, polyester, jute, polypropylene, cotton, and combinations thereof.

Figure 4:
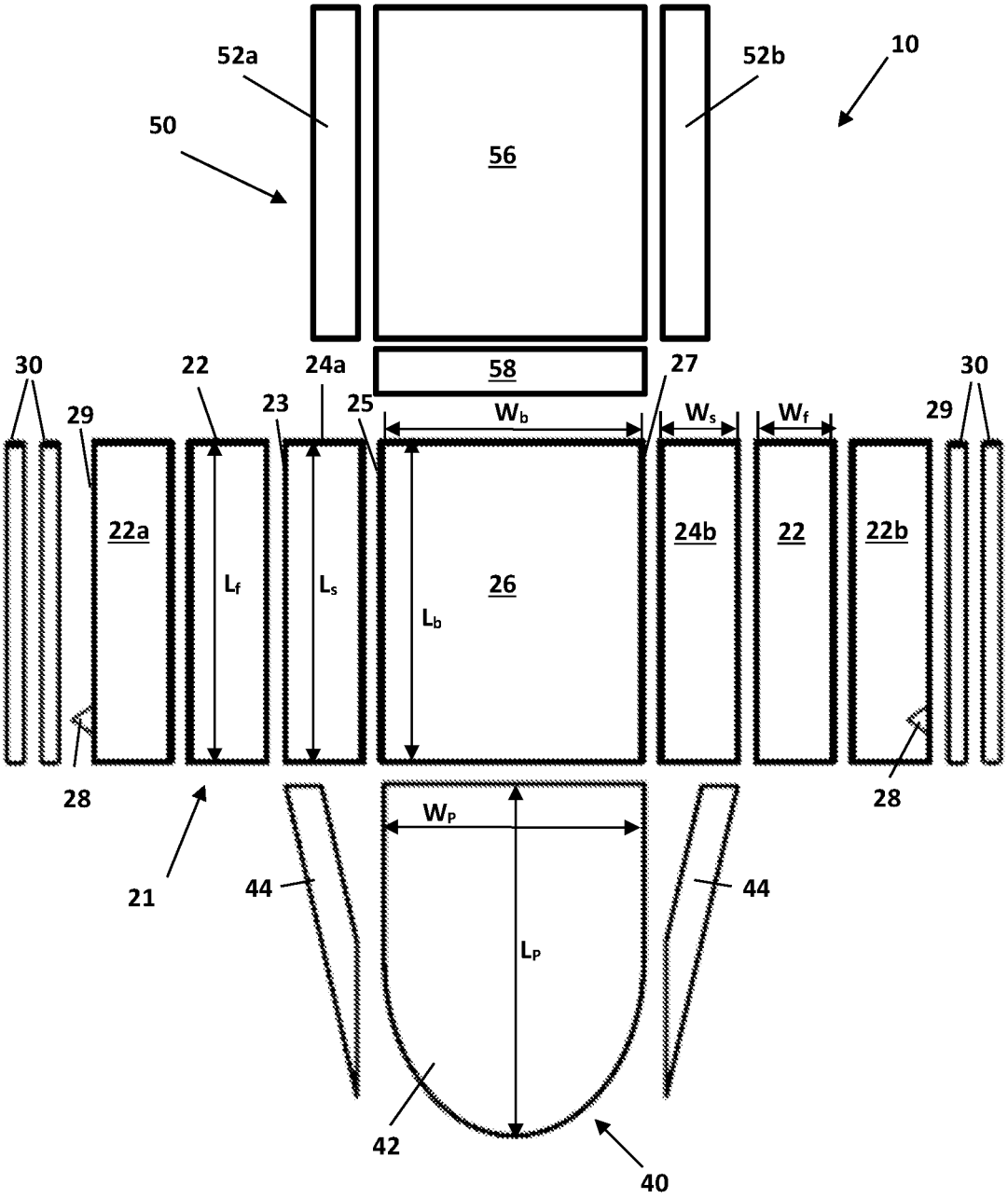
FIG. 4 shows the components comprising the backpack desk of FIG. 1 disassembled.
Figure 6C:
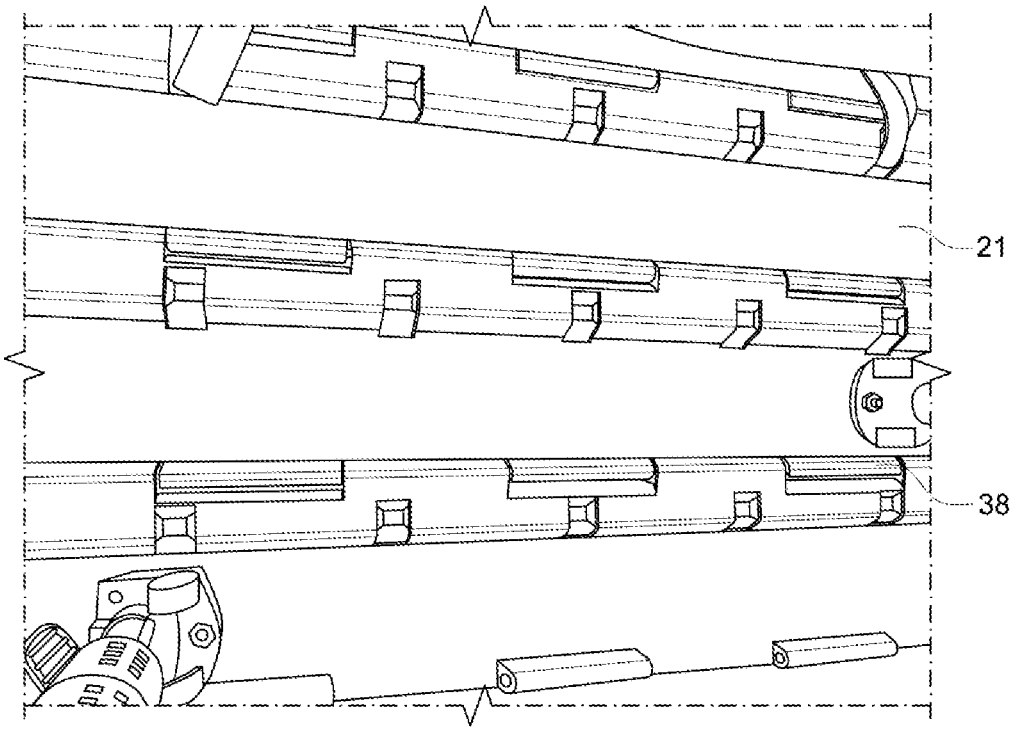
FIG. 6 shows the components of the backpack desk of FIG. 1 partially assembled, wherein (a) shows the panel 42 and straps 44, (b) shows the tote 50 and slats 21, (c) shows the slats 21 and hinges 38, (d) shows the leg 30 and leg hinges 32, and (e) shows the leg hinge 32.

The shell 20 is connected to the panel 42. Referring to FIGS. 2-4, the shell 20 defines an interior surface 20A and an exterior surface 20B, and comprises a tote 50 and a plurality of slats 21 that are secured together such that the slats 21 can form a planar surface 21A and the slats can also form a closed case 21B. In a preferred embodiment, the shell 20 comprises at least one front slat 22, at least two side slats 24, and at least one back slat or back plate 26. Each front slat 22 defines a length $L_f$, a width $W_f$, and a thickness $T_f$; each side slat 24 defines a length $L_s$, a width $W_s$, and a thickness $T_s$; and each back plate 26 defines a length $L_b$, a width $W_b$, and a thickness $T_b$. In a preferred embodiment, all the slats 21 have an essentially equal length and an essentially equal thickness, i.e. $L_f=L_s=L_b$ and $T_f=T_s=T_b$. The widths of the slats 21 may vary. In a preferred embodiment, the width of the back plate $W_b$ is greater than the width of the front slats $W_f$ or the width of the side slats $W_s$. In a more preferred embodiment, the width of the back plate $W_b$ is approximately equal to the width of the panel $W_P$.

The slats 21 can be made from any sturdy materials commonly used for making writing surfaces. Exemplary materials for the slats 21 include, but are not limited to, birch, pine, bamboo, natural wood, wood composite, fiberboard, medium density fiberboard, reinforced wood, laminate, melamine, aluminum, metal, acrylic, and combinations thereof. Optionally, the slats 21 may have beveled edges or rounded edges or smoothed edges to minimize the risk of snagging, but edge treatment is not required.

The slats 21 are connected to each other using hinges 38 or similar hardware that will allow the slats 21 to move relative to each other. In a preferred embodiment, the hinges are built into the edge of the slat, as shown in FIG. 6(*c*), although built-in hinges are not required.

The slats 21 are arranged such that the back plate 26 is connected to a first side slat 24*a* on a first side 25 and to a second side slat 24*b* on an opposing side 27, and then the first side slat 24*a* is connected to a front slat 22 on an opposing edge 23 to where the back plate is attached. If the width of the front slat 22 is shorter than the width of the back plate 26, additional front slats 22 may be connected in a similar manner either by connection to the second side slat 24*b* or by connection to the placed front slat 22 or by a combination thereof until sufficient slats 22 have been added to allow the slats 21 to meet when the backpack desk 10 is closed, thereby encircling the tote 50. This arrangement of slats 21 will result in two end slats 22*a*, 22*b* being attached to other slats 21 along only one edge, leaving the opposing edge 29 free. To hold the backpack desk 10 closed, a closure 28 is attached to the two slats 22*a*, 22*b* along the free edges 29 such that when the closure 28 is in a closed position, the backpack desk 10 is in a closed position. Exemplary closures 28 include, but are not limited to buckles, side-release buckles, straps, latches, or similar devices that reversibly attach to close. In a preferred embodiment, a side-release buckle is used.

The tote 50 comprises a wall 52 and a bottom panel 58. The wall 52 may be a single unit or the wall 52 may comprise a plurality of sections, such as side walls 54 and front walls 56. The bottom panel 58 attaches to a bottom edge 51 of the tote 50 so that items can be securely carried within the tote 50. The tote 50 may be made from a plurality of pieces of material, thereby having separate pieces of material for the walls 52 and/or the bottom panel 58, or the walls 52 and bottom panel 58 may comprise a single piece of material wherein the bottom panel 58 folds to attach to the walls 52 to create the tote 50. Exemplary materials for the tote 50 include, but are not limited to, birch, pine, bamboo, natural wood, wood composite, fiberboard, medium density fiberboard, reinforced wood, laminate, melamine, aluminum, metal, acrylic canvas, nylon, ripstop nylon, leather, polyester, polypropylene, polyethylene, ultra-high-molecular-weight polyethylene, cotton, polyvinyl chloride, and combinations thereof. Optionally, a cover may be secured to a top edge 53 of the tote 50 to protect the contents.

The back plate 26 supports the tote 50. When the backpack desk 10 is in the closed position, the walls of the tote 50 are surrounded by the slats 21. When the backpack desk 10 is in the open position, the tote 50 is located on the interior surface of the 20A which creates the underside of the planar surface 21A. In a first embodiment, as shown in FIGS. 4 and 6, the tote 50 is formed with the back plate 26 and walls 52 and a bottom panel 58. The back plate's inner surface, that is, the surface of the back plate 26 that forms the interior surface of the shell 20A, defines an inner surface for the tote 50. In an exemplary embodiment, a side wall 54*a* is secured to the first side 25 of the back plate 26 and a side wall 54*b* is secured to the opposing side 27 of the back plate 26 and a front wall 56 is secured to the side walls 54*a*, 54*b*, and a bottom panel is secured to the bottom edge of the back plate 26 and side walls 54*a*, 54*b* and front wall 56 to form the tote 50. In a second embodiment (not shown), the tote 50 is formed as a separate unit from the back plate 26 and is securely affixed to the back plate 26. The back plate 26 may be securely affixed to an exterior surface of the tote 50 or to an interior surface of the tote 50, using means known in the art, such as but not limited to, adhesives, brads, screws, Chicago screws, posts, or a combination thereof. If the back plate 26 is affixed to an interior surface of the tote 50, slits or apertures will need to be provided in the tote 50 to allow the slats 21 to attach to the back plate 26.

Figure 5:
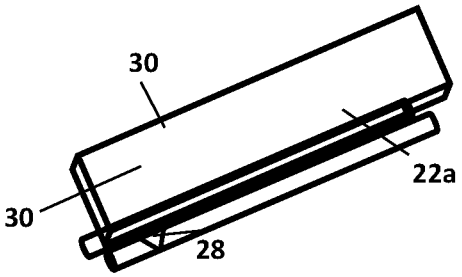
FIG. 5 shows the end slat of FIG. 4 with the legs attached.
Figure 6A:
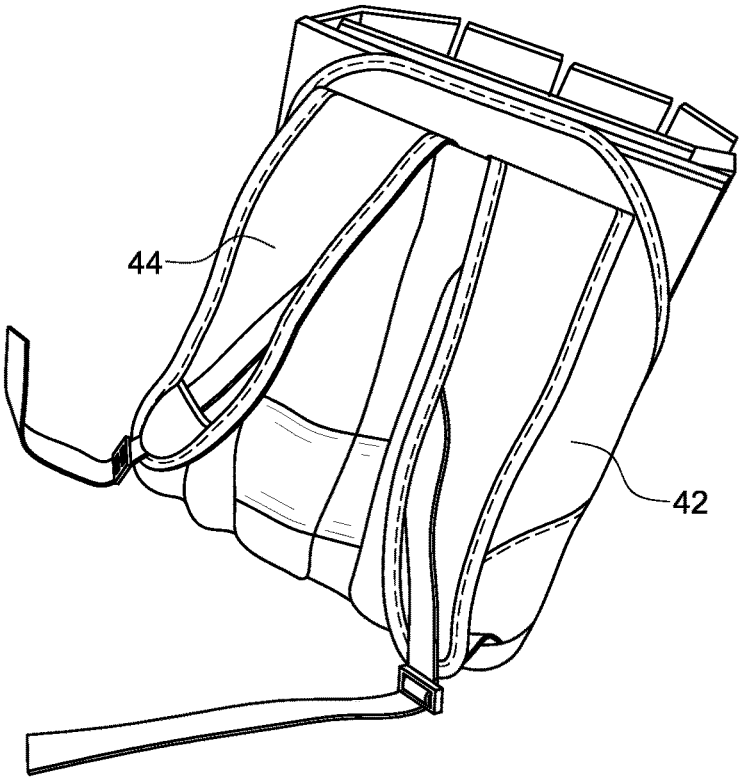
Figure 6B:
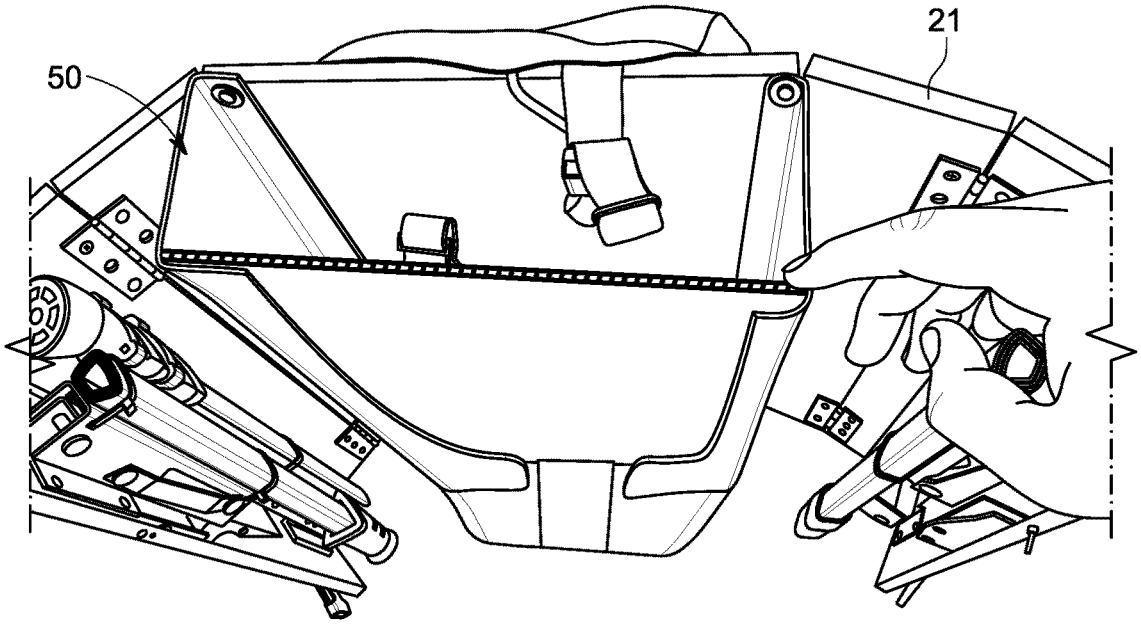
Figure 6D:
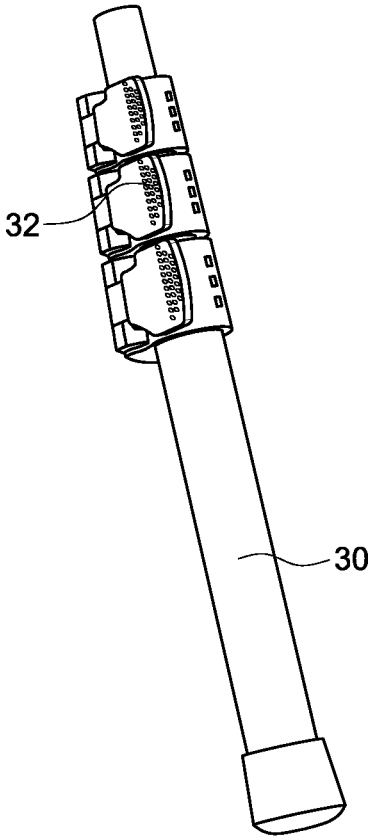
Figure 6E:
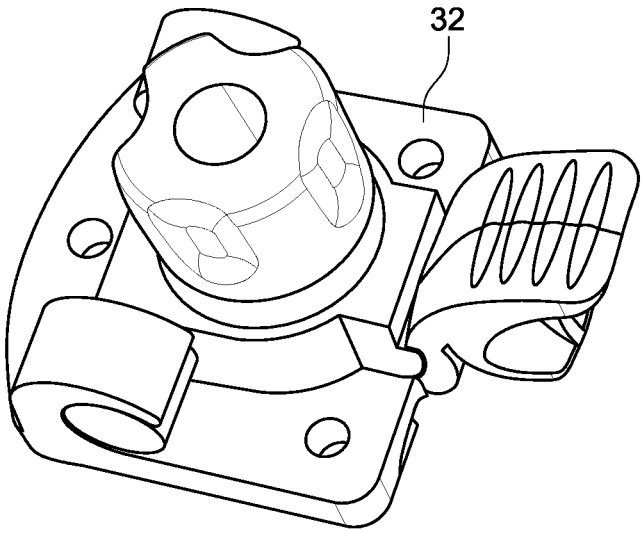

The closure 28 and legs 30 are secured to the end slats 22*a*, 22*b*. As shown in FIGS. 5, 6(*d*) and 6(*e*) using end slat 22*a* as an example, the closure 28 is secured to the exterior surface 20B and the legs 30 are attached to the interior surface 20A. The legs 30 are attached to the slat 22*a* using any means that allows the legs 30 to fold down and lay flat against the slat but also allows the legs 30 to rotate into an extended position or a position that is approximately perpendicular to the slat 22*a*. Exemplary attachment means include, without limitation, a leg hinge, a folding leg bracket, a hinge fitting, a fold-down hinge or a combination thereof. The legs 30 are attached such that the leg hinge 32 for a first leg is on a top edge 31 of the slat 22*a* and the leg hinge for the second leg 30*b* is on a bottom edge 33 of the slat 22*a*. The hinges and legs should be offset by a distance sufficient to allow the legs 30 to be in a folding position simultaneously, but close enough that the backpack desk 10 will be stable when the legs are extended. In a preferred embodiment, the legs 30 are telescoping legs, as are known in the art and as shown in FIG. 3.

The backpack desk 10 of the present invention allows a user to have a comfortable working surface at any location. The design allows the user to easily care the working surface to the desired location along with working supplies.

Unless defined otherwise, all technical and scientific terms used herein have the same meaning as commonly understood by one of ordinary skill in the art to which the presently disclosed subject matter pertains. Representative methods, devices, and materials are described herein, but are not intended to be limiting unless so noted.

The terms "a", "an", and "the" refer to "one or more" when used in the subject specification, including the claims. Unless otherwise indicated, all numbers expressing quantities of components, conditions, and otherwise used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

It is understood that, in light of a reading of the foregoing description, those with ordinary skill in the art will be able to make changes and modifications to the present invention without departing from the spirit or scope of the invention, as defined herein. For example, those skilled in the art may substitute materials supplied by different manufacturers than specified herein without altering the scope of the present invention.

What is claimed is:

1. A convertible backpack comprising a carrier, a shell, and legs, and wherein:

a. the carrier comprises a panel fitted with straps; and, b. the shell comprises a tote, a back plate, and a plurality of slats, and wherein:

i. the tote comprises a wall and a bottom panel; and, ii. the back plate defines an exterior surface and an interior surface, and the panel of the carrier is attached to the exterior surface of the back plate, and the tote is attached to the interior surface of the back plate; and, iii. the slats are secured together such that the slats form a planar surface and can be closed to partially encircle the tote, and wherein the secured slats define at least an end slat; and, iv. the end slat is attached to the back plate without obstructing the carrier or the tote; and, c. the legs are attached to the slats such that the legs can fold against the slats in a closed position or open to form substantially a 90° angle with the slats; and, wherein the shell can convert from a closed position that serves as a backpack to an open position that has a planar surface.

2. The backpack of claim 1 wherein the panel is made from canvas, nylon, ripstop nylon, leather, polyester, polypropylene, polyethylene, ultra-high-molecular-weight polyethylene, cotton, polyvinyl chloride, or combinations thereof.

3. The backpack of claim 1 wherein the straps are made from nylon, leather, polyester, jute, polypropylene, cotton, or combinations thereof.

4. The backpack of claim 1 wherein the tote is made from birch, pine, bamboo, natural wood, wood composite, fiberboard, medium density fiberboard, reinforced wood, laminate, melamine, aluminum, metal, acrylic canvas, nylon, ripstop nylon, leather, polyester, polypropylene, polyethylene, ultra-high-molecular-weight polyethylene, cotton, polyvinyl chloride, or a combination thereof.

5. The backpack of claim 1 wherein the slats are secured to each other with hinges.

6. The backpack of claim 1 wherein the slats are made from birch, pine, bamboo, natural wood, wood composite, fiberboard, medium density fiberboard, reinforced wood, laminate, melamine, aluminum, metal, acrylic, or a combination thereof.

7. The backpack of claim 1 wherein the slats have beveled edges or rounded edges or smoothed edges.

8. The backpack of claim 1 further including at least one closure affixed to at least one slat.

9. The backpack of claim 8 wherein the closure is a buckle, side-release buckle, strap, latch, or a combination thereof.

10. The backpack of claim 1 wherein the legs are attached to the slats with a leg hinge, a folding leg bracket, a hinge fitting, a fold-down hinge or a combination thereof.

11. The backpack of claim 1 wherein the legs are telescoping.

* * * * *